US008152967B2

(12) United States Patent
Graf

(10) Patent No.: US 8,152,967 B2
(45) Date of Patent: Apr. 10, 2012

(54) PROCESS AND MACHINE FOR MAKING AIR DRIED TISSUE

(76) Inventor: Edwin X. Graf, Washington Island, WI (US)

( * ) Notice: Subject to any disclaimer, the term of this patent is extended or adjusted under 35 U.S.C. 154(b) by 178 days.

(21) Appl. No.: 12/438,762

(22) PCT Filed: Aug. 15, 2007

(86) PCT No.: PCT/US2007/018155

§ 371 (c)(1),
(2), (4) Date: Apr. 8, 2009

(87) PCT Pub. No.: WO2008/027198

PCT Pub. Date: Mar. 6, 2008

(65) Prior Publication Data

US 2009/0321032 A1 Dec. 31, 2009

Related U.S. Application Data

(60) Provisional application No. 60/840,147, filed on Aug. 25, 2006.

(51) Int. Cl.
*D21G 9/00* (2006.01)

(52) U.S. Cl. ..... 162/289; 162/202

(58) Field of Classification Search ..... 162/289, 162/202, 207, 305, 306; 428/537.5; 34/452, 34/456, 360, 461, 305, 463, 640
See application file for complete search history.

(56) References Cited

U.S. PATENT DOCUMENTS

| | | | | |
|---|---|---|---|---|
| 3,982,328 | A | 9/1976 | Gustafsson et al. | |
| 4,218,833 | A | 8/1980 | Coar | |
| 4,770,745 | A | 9/1988 | Hildebrand et al. | |
| 5,471,766 | A * | 12/1995 | Heikkila et al. | 34/461 |
| 5,656,132 | A | 8/1997 | Farrington, Jr. et al. | |
| 5,749,164 | A | 5/1998 | Bowden | |
| 5,845,415 | A * | 12/1998 | Sundqvist | 34/452 |
| 5,925,407 | A * | 7/1999 | Ostman | 427/209 |
| 6,699,362 | B1 * | 3/2004 | Rautiainen | 162/136 |
| 6,712,931 | B1 * | 3/2004 | Gron et al. | 162/128 |
| 6,736,935 | B2 * | 5/2004 | Hermans et al. | 162/109 |
| 2009/0324980 | A1 * | 12/2009 | Matsushima | 428/537.5 |

FOREIGN PATENT DOCUMENTS

JP 2006-138045 * 6/2006

OTHER PUBLICATIONS

International Search Report dated May 27, 2008.
Christie, Doug. "Air Flow in an Airborne Dryer," *Pacific Coast Branch, Paptac*, Apr. 2002, 4 pgs.
"Boosting Dryer Capacity, DryWay™ Dryer," Company Brochure, Metso Paper, Inc., Finland, 8 pgs.
"Fläkt Drying Systems for Pulp & Paper," Company Brochure, Andritz Fiber Drying AB, Växjö, Sweden, 8 pgs.

* cited by examiner

*Primary Examiner* — Mark Halpern
(74) *Attorney, Agent, or Firm* — Woodcock Washburn LLP

(57) ABSTRACT

Described herein is a new concept in air dried tissue (ADT). The wet tissue web is received from the wet end of a paper-making machine and dried by an air floatation dryer that uses an endless loop to transport and support the wet tissue web as it is dried.

9 Claims, 2 Drawing Sheets

PROCESS AND MACHINE FOR MAKING AIR DRIED TISSUE

CROSS-REFERENCE TO RELATED APPLICATIONS

This application is the National Stage of International Application No. PCT/US2007/018155, filed Aug. 15, 2007, which claims the benefit of U.S. Provisional Application No. 60/840,147, filed Aug. 25, 2006, the disclosures of which are incorporated herein by reference in their entirety.

BACKGROUND

Traditional concepts presently employed today include but are not limited to through air drying (TAD) and conventional machines. An example of a process and machine for making tissue paper using TAD is set forth in U.S. Pat. No. 5,656,132, which is incorporated by reference. The most common methods of drying an uncoated or unsized sheet of paper, including tissue, use cast iron dryer cans or larger structures called "Flying Dutchman" or "Yankee Dryers," both of which are also cast iron drums. All of these conventional cast iron drums are rotating devices.

Examples of air floatation dryers and their use to dry a variety of substrates are set forth in U.S. Pat. Nos. 3,982,328, 4,218,833 and 5,749,164, each of which is incorporated by reference. Air floatation drying has been used on a paper machine after the paper web has been initially dried. The air floatation drier is arranged after a size press or a precoater, before the coated paper web enters a conventional dryer section composed of conventional cast iron dryer cans to dry the applied coating. The air floatation dryer was used in this manner to prevent the transfer of the wet coating or sizing chemicals to the hot conventional cast iron dryer cans. Air floatation dryers used for this purpose did not have an endless loop to support the wet, coated web in the dryer. Rather, the air cushion in the air floatation dryer would support the wet, coated paper web without contact with another surface. In this manner the surface of the freshly applied coating or chemicals was not damaged.

Pulp and heavy weight paper grades have been dried using an enclosed air dryer. The dryers used in such processes use a transport chain or metal belt that has a very open design that are unsuitable for conveying a wet tissue web and are not capable of the high speeds associated with tissue manufacture.

SUMMARY

The technology described herein provides a process and machine for making tissue grade paper, e.g., bath or facial tissue and towel products.

In one form, this technology comprises a method of making tissue grade paper where a furnish is provided to the wet end of a paper making machine and a wet web is formed. The wet web is transferred to an air floatation dryer where the wet web is dried.

In another form, this technology comprises a paper making machine that is capable of making tissue grade paper. The paper making machine comprises a wet end for forming a wet web and an air floatation dryer for drying the wet web.

In one form, the air floatation dryer comprises one or more air floatation dryer units through which the wet web is conveyed by way of a supporting endless loop.

By using an air floatation dryer section in a tissue making machine, enhanced fiber morphology is obtained. The air floatation dryer also provides a more efficient drying due to greater fiber surface availability to hot dry air at high velocities and more efficient contact of dry air molecules to carry away moisture. In addition, benefits associated to ADT are bulk, reduction in energy consumption (per ton produced), as well as capital costs and reduction in building height required for ADT vs. TAD. By providing an endless loop to convey and support the wet web through an air floatation dryer, sheet breaks become less of an issue which allows greater machine operating efficiency. The machine can be self threading.

DETAILED DESCRIPTION

Turning to the paper making method aspect of this technology, the initial wet web can be formed using conventional forming methods that are well known in the papermaking industry. For example, a Fourdrinier machine, twin wire machine, crescent former, C-wrap machine etc, can be used to form a wet web. The wet web is initially dewatered then transferred to an air floatation dryer and further dried. The air floatation dryer of the present invention may comprise one or more air floatation units. The wet web is supported by an endless loop as it is transferred through the air floatation dryer.

Turning to the paper making machine aspect of this technology, the paper making machine comprises a wet end and a dry end. The wet end may use any conventional wet former such as a Fourdrinier machine, twin wire machine, crescent former or C-wrap machine etc. The dry end comprises an air floatation dryer. The air floatation dryer may comprise one or more air floatation units. The air floatation dryer uses an endless loop to support and convey the wet web through the unit(s).

Figure 1:
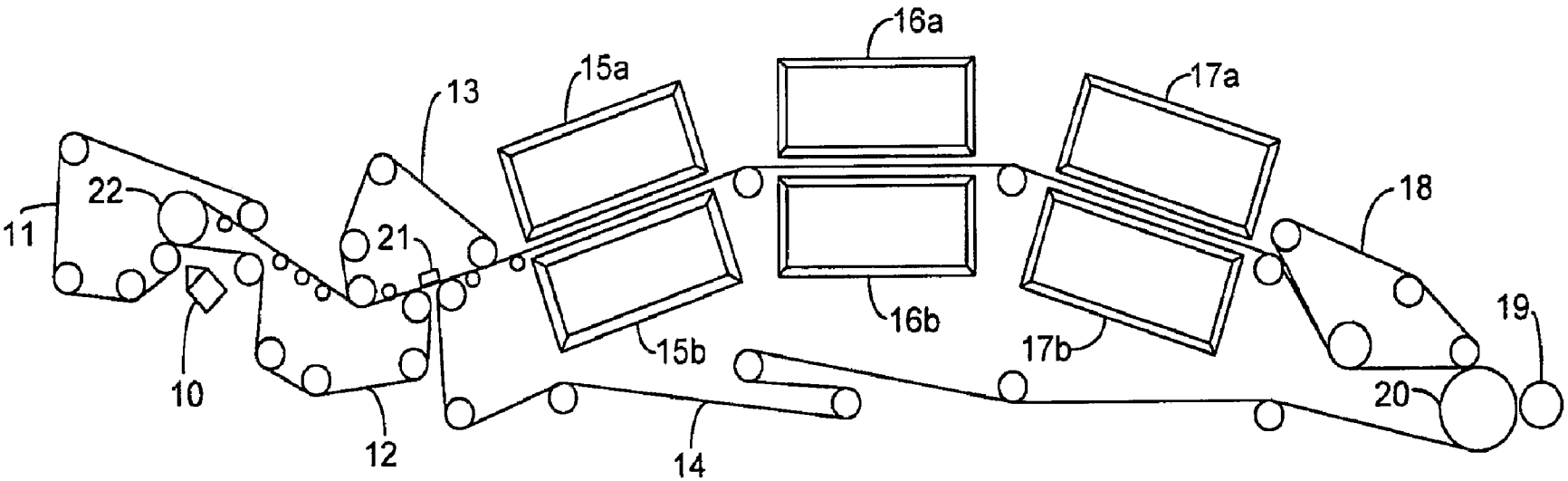
FIG. 1 is a depiction of an embodiment where an air floatation dryer is used.

FIG. 1 illustrates an exemplary papermaking machine according to this technology. In this illustration, a fiber furnish is supplied to the nip formed by the inner forming fabric 12 and outer forming fabric 11 of a C-wrap former by way of a headbox 10. The furnish is conveyed by the inner and outer forming fabrics around a forming roll 22. Any headbox that is conventionally used in making tissue grade paper can be used in the present invention. For example, the headbox described in U.S. Pat. No. 4,770,745, which is incorporated by reference, may be used. The headbox may be layered or non-layered. The properties of a layered product may be adjusted by altering the composition of the various layers. The inner and outer forming fabrics wrap around the forming roll an appropriate distance. In some circumstances it is preferred that the inner and outer forming fabrics wrap around the forming roll approximately 180° of the forming roll's surface.

The inner and outer forming fabrics may be any conventional tissue grade forming fabrics. The inner and outer forming fabrics, by way of example, may be formed of polyester and may use nylon monofilament to increase wear properties. The inner and outer forming fabrics may be treated to increase release properties.

Additional dewatering devices may be used in the wet end as needed or desired, for example, steam boxes and other drainage elements.

The wet tissue web is transferred to an air floatation dryer device. Any conventional manner of transferring a wet web from the wet end of a papermaking machine to the dry end may be used. As illustrated in FIG. 1, the transfer may occur by way of a transfer fabric 13 and a suction transfer box 21. In some circumstances it is preferred that the transfer section be constructed as illustrated in FIG. 1 where the dewatering roll is positioned to deflect the inner forming fabric inward in order to enhance dewatering of the wet web.

The air floatation dryer device may be of any conventional design such as those set forth in U.S. Pat. Nos. 3,982,328, 4,218,833 and 5,749,164, discussed above. The wet tissue web received from the wet end is transported through the air floatation dryer device while supported by an endless loop. In stating that the wet tissue web is supported, it is understood that due to air movement within the dryer, the wet tissue web may not be in contact with the endless loop at all times during its transit through the air floatation dryer. As illustrated in FIG. 1, the wet tissue web is transported through the air floatation dryer while supported on a dryer fabric 14. The temperature of the air in the air floatation dryer device may range from about 212-1,000° F. or higher. the dryer fabric may be woven from polyester or other polymers, and materials that are compounded for greater heat resistance. The hot air used in the air floatation drier may be heated by conventional energy sources such as steam, natural gas, oil, propane, geothermal, solar etc. Thermal efficiency of the air floatation dryer device can be enhanced by providing a heat recovery system so that the high humidity heat values of the exhaust air can be used, e.g., to heat the fresh makeup air.

While illustrated as having three air floatation drier units, 15*a* and 15*b*; 16*a* and 16*b*; 17*a* and 17*b*, this technology may comprise a single air floatation unit. It is also understood that other conventional drier units, such as steel drums or a Yankee dryer, may be used after the web emerges from the air floatation drying operation as desired.

The air floatation dryer may also contain an arrangement for cooling the endless loop. In addition the air floatation dryer may also contain an air support arrangement for the endless loop such as nozzles, air boxes or shoes and may use the Coanda effect. U.S. Pat. Nos. 3,982,328, 4,218,833 and 5,749,164 describe air floatation dryers that use such elements.

The dried tissue web is transported to a reel 20. As illustrated in FIG. 1, the dried tissue web may be transferred to the reel by way of a transfer fabric 18. Any conventional reel may be used, preferably a center wind reel.

As illustrated in FIG. 1, the tissue web is preferably supported by solid surfaces throughout the papermaking process. Thus, sheet breaks will become less of an issue with the attendant gain in machine operating efficiency due to reduced machine threading times. By solid surface it is meant that the tissue web is supported by something other than a cushion of air as are coated webs dried in previous air floatation devices. The various belts or fabrics used in the present invention are made of solid materials but may be porous as needed for efficient dewatering and drying. Thus, woven and nonwoven belts and fabrics are useful to support the tissue web as it is formed and dried. While it is preferred that the tissue web is supported by a solid surface throughout the papermaking process, this technology also includes embodiments where the tissue web can be conveyed when not supported by a solid surface, e.g., through an open draw, if the tissue web has achieved sufficient strength.

Suitable papermaking fibers for this invention include cellulosic and synthetic fibers that are useful in making tissue paper. The fibers may be virgin or recycled.

Figure 2:
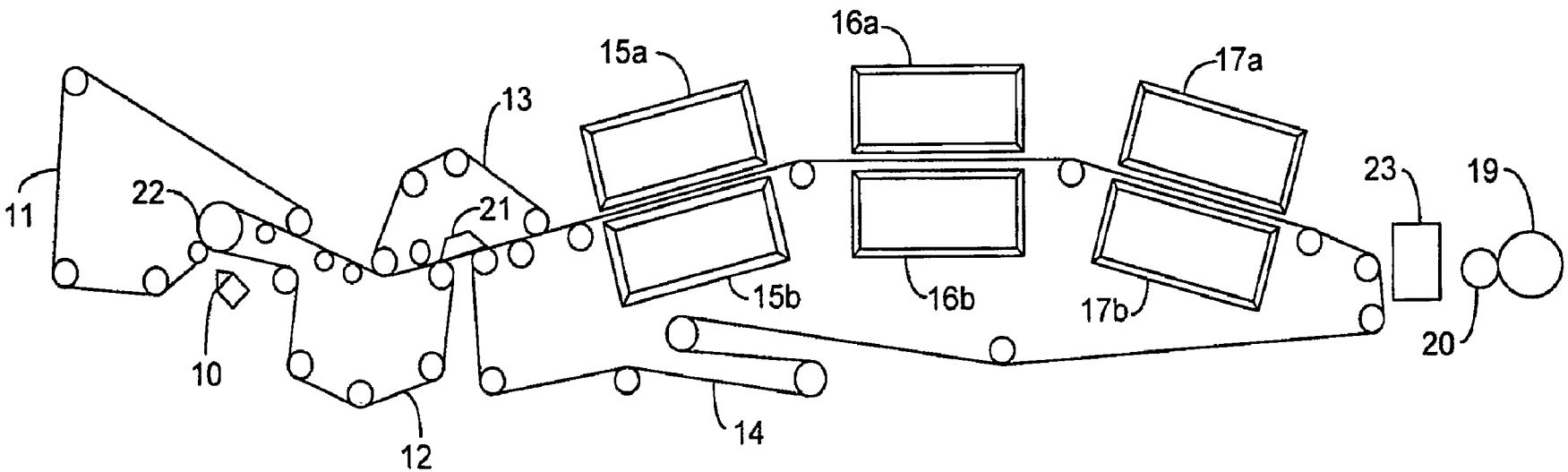
FIG. 2 is a depiction of an alternate embodiment where an air floatation dryer is used.

FIG. 2 illustrates another exemplary papermaking machine according to this technology. In this illustration, a fiber furnish is supplied to the nip formed by the inner forming fabric 12 and outer forming fabric 11 of a C-wrap former by way of a headbox 10. The furnish is conveyed by the inner and outer forming fabrics around a forming roll 22. Any headbox that is conventionally used in making tissue grade paper can be used in the present invention. For example, the headbox described in U.S. Pat. No. 4,770,745, which is incorporated by reference, may be used. The headbox may be layered or nonlayered. The properties of a layered product may be adjusted by altering the composition of the various layers. The inner and outer forming fabrics wrap around the forming roll an appropriate distance. In some circumstances it is preferred that the inner and outer forming fabrics wrap around the forming roll approximately 180° of the forming roll's surface.

The inner and outer forming fabrics again may be any conventional tissue forming fabrics. The inner and outer forming fabrics, by way of example, may be formed of polyester and may use nylon monofilament to increase wear properties. The inner and outer forming fabrics may be treated to increase release properties.

Additional dewatering devices may be used in the wet end as needed or desired, for example, steam boxes and other drainage elements.

The wet tissue web is transferred to an air floatation dryer device. Any conventional manner of transferring a wet web from the wet end of a papermaking machine to the dry end may be used. As illustrated in FIG. 2, the transfer may occur by way of a transfer fabric 13 and a suction transfer box 21. In some circumstances it is preferred that the transfer section be constructed as illustrated in FIG. 2 where the dewatering roll is positioned to deflect the inner forming fabric inward in order to enhance dewatering of the wet web.

The air floatation dryer device may be of any conventional design such as those set forth in U.S. Pat. Nos. 3,982,328, 4,218,833 and 5,749,164, discussed above. The wet tissue web received from the wet end is transported through the air floatation dryer device while supported by an endless loop. In stating that the wet tissue web is supported, it is understood that due to air movement within the dryer, the wet tissue web may not be in contact with the endless loop at all times during its transit through the air floatation dryer. As illustrated in FIG. 1, the wet tissue web is transported through the air floatation dryer while supported on a dryer fabric 14. The temperature of the air in the air floatation dryer device may range from about 212-1,000° F. or higher. The dryer fabric may be woven from polyester or other polymers that are compounded for greater heat resistance. The hot air used in the air floatation drier may be heated by conventional energy sources such as steam, natural gas, oil, propane, geothermal, solar etc. Thermal efficiency of the air floatation dryer device can be enhanced by providing a heat recovery system so that the high humidity heat values of the exhaust air can be used, e.g., to heat the fresh makeup air.

While illustrated as having three air floatation drier units, 15*a* and 15*b*; 16*a* and 16*b*; 17*a* and 17*b*, this technology may comprise a single air floatation unit. It is also understood that other conventional drier units, such as steel drums or a Yankee dryer, may be used after the web emerges from the air floatation drying operation as desired.

The air floatation dryer may also contain an arrangement for cooling the endless loop. In addition the air floatation dryer may also contain an air support arrangement for the endless loop such as nozzles, air boxes or shoes and may use the Coanda effect. U.S. Pat. Nos. 3,982,328, 4,218,833 and 5,749,164 describe air floatation dryers that use such elements.

The dried tissue web is transported to a reel 20 which forms parent roll 19. In contrast to the embodiment illustrated in FIG. 1, the dried tissue web is not transferred to the reel by way of a transfer fabric. Any conventional reel may be used, preferably a center wind reel.

Additional equipment may be used in practicing this technology that is normally used in making paper. For example, a scanner and hole detector may be used as illustrated at 23 of FIG. 2. Another example of additional equipment that may be used would be a static eliminator.

While the foregoing disclosure shows illustrative embodiments of this technology, it should be noted that various changes and modifications could be made herein without departing from the scope of the invention as defined by the appended claims. Furthermore, although elements of this technology may be described in the singular, the plural is intended unless limitation to singular is explicitly stated.

I claim:

1. A papermaking machine comprising:

a. a wet end for forming a web and b. a dry end, wherein the dry end comprises an air floatation drier having an endless loop for substantially supporting the web.

2. A papermaking machine according to claim 1 wherein the wet end comprises an inner forming wire and outer forming wire associated with a forming roll.

3. A papermaking machine according to claim 2 wherein the inner and outer forming wires are wrapped around up to about 180° of the forming roll surface.

4. A papermaking machine according to claim 2 further comprising a transfer fabric for transferring the wet web to the air floatation drier.

5. A papermaking machine according to claim 4 wherein the transfer fabric and the inner forming fabric are arranged so that the inner forming fabric is deflected inwards.

6. A papermaking machine according to claim 1 further comprising a reel.

7. A papermaking machine according to claim 1 wherein the web is substantially supported on solid surfaces throughout the machine.

8. A papermaking machine according to claim 1 further comprising at least one cooler for the endless loop.

9. A papermaking machine according to claim 1 further comprising an air support arrangement for the endless loop.

* * * * *